US009226352B2

(12) United States Patent
Wan et al.

(10) Patent No.: US 9,226,352 B2
(45) Date of Patent: Dec. 29, 2015

(54) DRIVER CIRCUIT AND DRIVING METHOD FOR LED LIGHTING DEVICE

(71) Applicant: ZHEJIANG SHENGHUI LIGHTING CO., LTD, Jiaxing (CN)

(72) Inventors: Yehua Wan, Jiaxing (CN); Jinxiang Shen, Jiaxing (CN)

(73) Assignee: ZHEJIANG SHENGHUI LIGHTING CO., LTD, Jiaxing (CN)

( * ) Notice: Subject to any disclaimer, the term of this patent is extended or adjusted under 35 U.S.C. 154(b) by 0 days.

(21) Appl. No.: 14/488,345

(22) Filed: Sep. 17, 2014

(65) Prior Publication Data

US 2015/0002038 A1 Jan. 1, 2015

Related U.S. Application Data

(63) Continuation-in-part of application No. PCT/CN2013/076565, filed on May 31, 2013.

(30) Foreign Application Priority Data

Apr. 15, 2013 (CN) ..... 201310131926

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
USPC ..... 315/291, 200 R, 209 R, 294, 297
See application file for complete search history.

(56) References Cited

U.S. PATENT DOCUMENTS 7,550,934 B1 6/2009 Deng et al.
2012/0319604 A1* 12/2012 Walters ..... 315/200 R

FOREIGN PATENT DOCUMENTS

CN 101742758 A 6/2010
CN 101925230 A 12/2010
CN 201839477 U 5/2011
CN 102612224 A 7/2012
CN 203233576 U 10/2013

* cited by examiner

*Primary Examiner* — Douglas W Owens
*Assistant Examiner* — Jonathan Cooper
(74) *Attorney, Agent, or Firm* — Anova Law Group, PLLC

(57) ABSTRACT

Driver circuit and driving method for an LED lighting device are provided. The driver circuit includes an AC power supply, a dimmer, a transformer, and/or a dimming control circuit. The dimming control circuit includes a filtering unit, a rectifying unit, a boost converter unit, a control-signal conversion unit, and/or a buck converter unit. A dimming position is defined at a point in the driver circuit to perform a dimming control process of the LED lighting device by the dimmer. A voltage corresponding to the point is boosted by the boost converter unit to provide a boosted voltage. The boosted voltage is sampled and converted by the control-signal conversion unit into an analog control voltage signal acceptable by a buck converter unit. The buck converter unit alters an amount of a current of the LED lighting device, after receiving the analog control voltage signal.

4 Claims, 2 Drawing Sheets

DRIVER CIRCUIT AND DRIVING METHOD FOR LED LIGHTING DEVICE

CROSS-REFERENCES TO RELATED APPLICATIONS

This application is a continuation-in-part of PCT Application No. PCT/CN2013/076565, filed on May 31, 2013, which claims the priority to Chinese Patent Application No. 201310131926.X, filed on Apr. 15, 2013, the entire contents of which are incorporated herein by reference.

FIELD OF THE DISCLOSURE

The present disclosure relates to the field of LED (light emitting diode) lighting technology and, more particularly, relates to a driver circuit and a driving method for an LED lighting device.

BACKGROUND

LED lamps have been widely used in various areas for public, commercial, and indoor lighting. LED lighting may provide advantages such as energy conservation, environmental protection, controllable lighting, solid state lighting, and long operational lifetime.

Conventional LED lamps may have lamp-head structures generally-designed same as for incandescent lamps, energy saving lamps, and other conventional lamps. Presumably, LED lamps may be used to directly replace other conventional lamps by an easy installation without changing original structures of other conventional lamp systems.

However, when other lamps are replaced by LED lamps, the dimming feature of the LED lamps may not be applied. This is because those lamps may not include any dimmers to implement the dimming feature. Adding a dimmer in the lighting systems can increase the cost and require additional and complicated installation.

BRIEF SUMMARY OF THE DISCLOSURE

One aspect or embodiment of the present disclosure includes a driver circuit of an LED lighting device. The driver circuit includes a dimmer connected to an AC power supply, a transformer connected to the dimmer, and a dimming control circuit connected to the transformer. The dimming control circuit includes a filtering unit, a rectifying unit, a boost converter unit, a voltage feedback control circuit unit, and a buck converter unit.

The filtering unit is configured to filter a voltage signal from the transformer and to output the voltage signal after filtering. The rectifying unit is configured to receive the voltage signal from the filtering unit and to rectify the voltage signal into a DC voltage signal to output. The boost converter unit is configured to receive the DC voltage signal from the rectifying unit to boost a DC voltage to provide a boosted voltage. The voltage feedback control circuit unit is configured to control the boosted voltage from the boost converter unit. The buck converter unit is configured to convert the boosted voltage into a voltage and a current for the LED lighting device.

The dimming control circuit further includes a control-signal conversion unit connected to each of the boost converter unit, the voltage feedback control circuit unit, and the buck converter unit. The dimmer is configured to define a point of a dimming position in the driver circuit such that a current of the LED lighting device is related to the dimming position and related to a voltage corresponding to the point of the dimming position. The boost converter unit is configured to boost the voltage corresponding to the point of the dimming position to provide the boosted voltage corresponding to the point of the dimming position. The control-signal conversion unit is configured to adjust an amount of the current required by the buck converter unit according to the boosted voltage corresponding to the point of the dimming position.

The control-signal conversion unit includes a filter processing circuit and an analog-operation amplifier. The filter processing circuit is configured to sample the boosted voltage corresponding to the point of the dimming position to provide a sampled voltage signal. The analog-operation amplifier is configured to convert the sampled voltage signal into an analog control voltage signal acceptable by the buck converter unit.

The dimming control circuit further includes an LED cathode-voltage detecting unit and a current-input control unit. The LED cathode-voltage detecting unit is configured to detect a cathode voltage of the LED lighting device and to output a voltage signal corresponding to the detected cathode voltage to the current-input control unit. The current-input control unit is connected to the rectifying unit to control an input current to the LED lighting device. The current-input control unit is further configured to receive the voltage signal from the LED cathode-voltage detecting unit and, accordingly, to control an amount of a current from the rectifying unit as the input current to the LED lighting device to increase smoothness of the dimming control process.

Optionally, the transformer includes an electronic induction transformer, and the dimmer includes a phase-cutting dimmer.

Another aspect or embodiment of the present disclosure includes a driving method for an LED lighting device. A dimming position is defined at a point in a driver circuit by a dimmer to perform a dimming control process of the LED lighting device. A voltage corresponding to the point of the dimming position is boosted by a boost converter unit to provide a boosted voltage. The boosted voltage corresponding to the point of the dimming position is sampled to provide a sampled voltage signal by a control-signal conversion unit. The sampled voltage signal is converted by the control-signal conversion unit into an analog control voltage signal acceptable by a buck converter unit. The buck converter unit alters an amount of a current of the LED lighting device, after receiving the analog control voltage signal.

Optionally, a cathode voltage of the LED lighting device is detected by an LED cathode-voltage detecting unit. A voltage signal corresponding to the cathode voltage is sent from the LED cathode-voltage detecting unit to a current-input control unit. According to the voltage signal corresponding to the cathode voltage from the LED cathode-voltage detecting unit, the current-input control unit alters an amount of an input current of the LED lighting device to increase smoothness of the dimming control process.

To sample and convert the boosted voltage, the boosted voltage is detected and then sampled by a filter processing circuit in the control-signal conversion unit to provide the sampled voltage signal. The sampled voltage signal is converted into the analog control voltage signal by removing high-frequency interference and low-frequency disturbance by an analog-operation amplifier. The analog control voltage signal is also processed by the analog-operation amplifier in the control-signal conversion unit. The processed analog control voltage signal is sent to the buck converter unit.

Optionally, the boosted voltage corresponding to the point of the dimming position is controlled by a voltage feedback control circuit unit before the boosted voltage is sampled.

The amount of the current of the LED lighting device is altered by the buck converter unit to dynamically balance an input power and an output power of the LED lighting device. The input power of the LED lighting device is obtained from a transformer connected to an AC power supply.

Optionally, before boosting the voltage corresponding to the point of the dimming position, an AC voltage signal from a transformer is filtered and rectified into a DC voltage signal. The DC voltage signal provides the voltage corresponding to the point of the dimming position. The transformer includes an electronic induction transformer.

Another aspect or embodiment of the present disclosure includes a driver circuit for an LED lighting device. The driver circuit includes a dimmer, a boost converter unit, a control-signal conversion unit, and a buck converter unit. The dimmer is configured to define a dimming position at a point in a driver circuit to perform a dimming control process of the LED lighting device. The boost converter unit is configured to boost a voltage corresponding to the point of the dimming position to provide a boosted voltage. The control-signal conversion unit is configured to sample the boosted voltage corresponding to the point of the dimming position to provide a sampled voltage signal; and to convert the sampled voltage signal into an analog control voltage signal acceptable by a buck converter unit. The buck converter unit is configured to alter an amount of a current of the LED lighting device, after the buck converter unit receives the analog control voltage signal.

The driver circuit further includes an LED cathode-voltage detecting unit and a current-input control unit. The LED cathode-voltage detecting unit is configured to detect a cathode voltage of the LED lighting device. The current-input control unit is configured to alter an amount of an input current of the LED lighting device to increase smoothness of the dimming control process, according to the voltage signal corresponding to the cathode voltage from the LED cathode-voltage detecting unit.

The driver circuit further includes a voltage feedback control circuit unit configured to control the boosted voltage corresponding to the point of the dimming position before the boosted voltage is sampled.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Figure 1A:
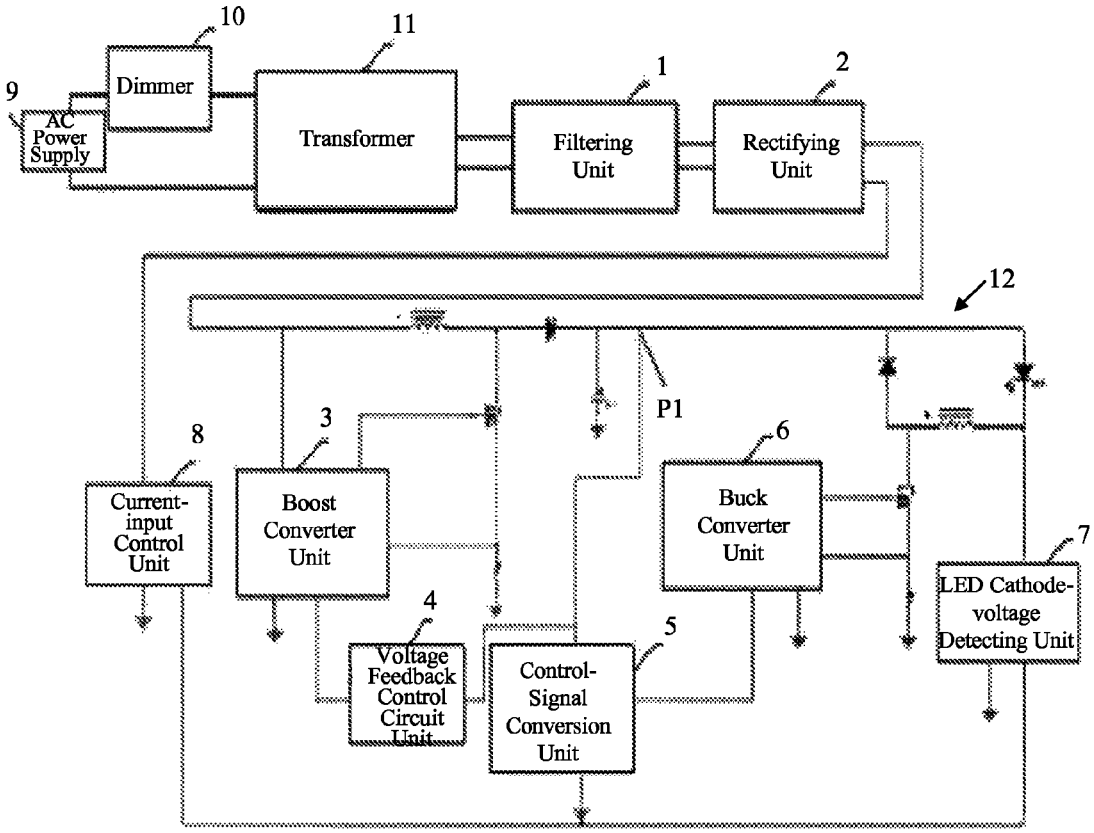
FIG. 1A is a schematic illustrating an exemplary driver circuit for an LED lighting device consistent with various disclosed embodiments.

Reference will now be made in detail to exemplary embodiments of the disclosure, which are illustrated in the accompanying drawings. Wherever possible, the same reference numbers will be used throughout the drawings to refer to the same or like parts.

A driver circuit and driving method of an LED lighting device are provided. An exemplary driver circuit includes an AC power supply, a dimmer, a transformer, and/or a dimming control circuit. The dimming control circuit includes a filtering unit, a rectifying unit, a boost converter unit, a voltage feedback control circuit unit, a control-signal conversion unit, and/or a buck converter unit. Optionally, the dimming control circuit further includes an LED cathode-voltage detecting unit and/or a current-input control unit.

In one embodiment, the filtering unit is configured to filter a voltage signal from the transformer and to output the voltage signal after filtering. The rectifying unit is configured to receive the voltage signal from the filtering unit and to rectify the voltage signal into a DC signal to output. The boost converter unit is configured to receive the DC signal from the rectifying unit to boost a voltage as a DC voltage that is required. The voltage feedback control circuit unit is configured to control the boosted voltage from the boost converter unit. The buck converter unit is configured to convert the boosted voltage into a voltage and a current required by the LED lighting device.

When performing a dimming control process, the dimmer can define a dimming position of a point in the driver circuit of the LED lighting device. The current of the LED lighting device is related to the dimming position and related to a voltage corresponding to the point of dimming position. The control-signal conversion unit is introduced to "automatically" (e.g., due to configuration of the disclosed driver circuit) adjust a voltage signal at the point of dimming position into an amount of a current required by the buck converter unit to dynamically balance an input power and an output power of the LED lighting device such that no flashing or dimming failure phenomena occur to the LED lighting device.

In various embodiments, when the dimmer is rotated, the voltage of the point of dimming position can change. By use of the control-signal conversion unit, corresponding analog dimming signal (also referred to as analog control voltage signal) is outputted to the buck converter unit to alter an amount of current of the buck converter unit outputted to the LED lighting device.

Optionally, the dimming control circuit further includes an LED cathode-voltage detecting unit, configured to detect a cathode voltage of the LED lighting device and to output a voltage signal corresponding to the detected cathode voltage. The dimming control circuit further includes a current-input control unit, configured to receive the voltage signal from the LED cathode-voltage detecting unit and also to control an amount of a current from the rectifying unit to increase smoothness of the dimming control process.

In operation, after powering on the LED lighting device, the dimmer performs the dimming control process to the LED lighting device. The control-signal conversion unit firstly samples the voltage corresponding to the point of dimming position after being boosted by the boost converter unit to provide the sampled voltage signal. The control-signal conversion unit then converts the sampled voltage signal into the analog control voltage signal acceptable by the buck converter unit. After receiving the analog control voltage signal, the buck converter unit controls an amount of a current of the LED lighting device. In addition, the LED cathode-voltage detecting unit and the current-input control unit can be used to control amount of an input current of the LED lighting device to increase smoothness of the dimming control process.

FIG. 1A is a schematic illustrating an exemplary driver circuit for an LED lighting device consistent with various disclosed embodiments. As used herein, the term "driver circuit of an LED lighting device" can also be referred to as an "LED driver circuit". In one embodiment, the LED driver circuit can be a driver circuit simultaneously compatible with a transformer, such as an electronic induction transformer, and a dimmer, such as a phase-cutting dimmer.

As shown in FIG. 1, an exemplary LED driver circuit includes: an AC power supply 9, a dimmer 10, a transformer 11, and/or a dimming control circuit 12. Each of the AC power supply 9, the dimmer 10, and/or the transformer 11 can include known control structures as desired. The AC power supply 9, the dimmer 10, and/or the transformer 11 can be connected with one another as shown in FIG. 1.

As disclosed herein, exemplary dimming control circuit 12 in the LED driver circuit includes a filtering unit 1, a rectifying unit 2, a boost converter unit 3, a voltage feedback control circuit unit 4, a control-signal conversion unit 5, a buck converter unit 6, an LED cathode-voltage detecting unit 7, and/or a current-input control unit 8.

When the LED driver circuit is in operation, the filtering unit 1 can filter a voltage signal from the transformer 11, and output the voltage signal after filtering to the rectifying unit 2 to rectify the voltage signal into a DC signal. The DC signal can be outputted to the boost converter unit 3. The boost converter unit 3 can boost the DC signal to provide a boosted voltage, e.g., a DC voltage that is required by the LED lighting device. The boosted voltage from the boost converter unit can be controlled by the voltage feedback control circuit unit 4. The buck converter unit 6 can convert the boosted voltage into a voltage and a current required by the LED lighting device.

The dimming control circuit 12 can be used to implement a dimming control process. When the dimmer 10 performs an exemplary dimming control process for the LED lighting device, a dimming position can be set or defined or selected by the dimmer 10 at a point in the LED driver circuit. For example, a point P1 between the rectifying unit 2 and the LED cathode-voltage detecting unit 7 (or the LED lighting device) as shown in FIG. 1 can be defined as a point of dimming position for the dimming control process. The amount of current of the LED lighting device can be related to the dimming position at point P1 and also related to corresponding voltage at point P1.

A voltage corresponding to the point P1 can be boosted by the boost converter unit 3 to provide a boosted voltage. The control-signal conversion unit 5 can sample the boosted voltage corresponding to the point P1 to provide a sampled voltage signal. The sampled voltage signal can be converted, by the control-signal conversion unit 5, into an analog control voltage signal acceptable by the buck converter unit 6. The analog control voltage signal can also be referred to as an analog dimming signal. After the buck converter unit 6 receives the analog control voltage signal, the buck converter unit 6 can control an amount of a current of the LED lighting device.

According to the voltage corresponding to the point P1, the control-signal conversion unit 5 can automatically adjust a current amount required by the buck converter unit 6 to dynamically balance an input power (i.e., output power from the transformer) and an output power (i.e., power of the LED lighting device). In this manner, flashing or dimming failure phenomena do not occur.

Figure 1B:
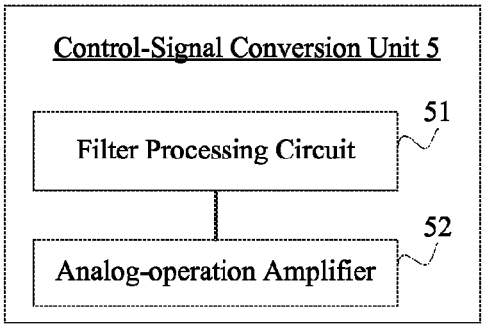
FIG. 1B is a schematic illustrating an exemplary control-signal conversion unit of an LED driver circuit consistent with various disclosed embodiments.

For example, the control-signal conversion unit 5 can include a filter processing circuit 51 and/or an analog-operation amplifier 52, as shown in FIG. 1B.

After the control-signal conversion unit 5 detects the voltage or the boosted voltage at point P1, the boosted voltage can be internally processed by the filter processing circuit 51 in the control-signal conversion unit 5. The resultant, sampled voltage signal can be converted into a clean analog control voltage signal by removing high-frequency interference and low-frequency disturbance. Such process can eliminate fluctuations in the output current of the LED lighting device to avoid flicker and to stabilize dimming signal.

After the analog control voltage signal is internally processed by the analog-operation amplifier 52 of the control-signal conversion unit 5, the analog control voltage signal can be transmitted to the buck converter unit 6. Such analog control voltage signal can directly alter a reference voltage value of the output current to the LED lighting device. When changes are made to the reference voltage value of the output current of the buck converter unit 6 to the LED lighting device, the output current can change accordingly. Therefore, when the dimmer 2 is turned or rotated, the voltage of point P1 can change. Then, via the control-signal conversion unit 5, corresponding analog dimming signal can be outputted to the buck converter unit 6 to alter an amount of current of the buck converter unit and the LED lighting device.

In addition, the LED cathode-voltage detecting unit 7 can be configured to detect a cathode voltage of the LED lighting device and to output a voltage signal corresponding to the cathode voltage to the current-input control unit 8. The current-input control unit 8 can be connected to the rectifying unit 2 to control a current outputted from the rectifying unit 2. According to the voltage signal corresponding to the cathode voltage from the LED cathode-voltage detecting unit 7, the current-input control unit 8 can then alter amount of the current outputted from the rectifying unit 2 (which is an input current to the LED lighting device) to further increase smoothness of the dimming control process.

Figure 2:
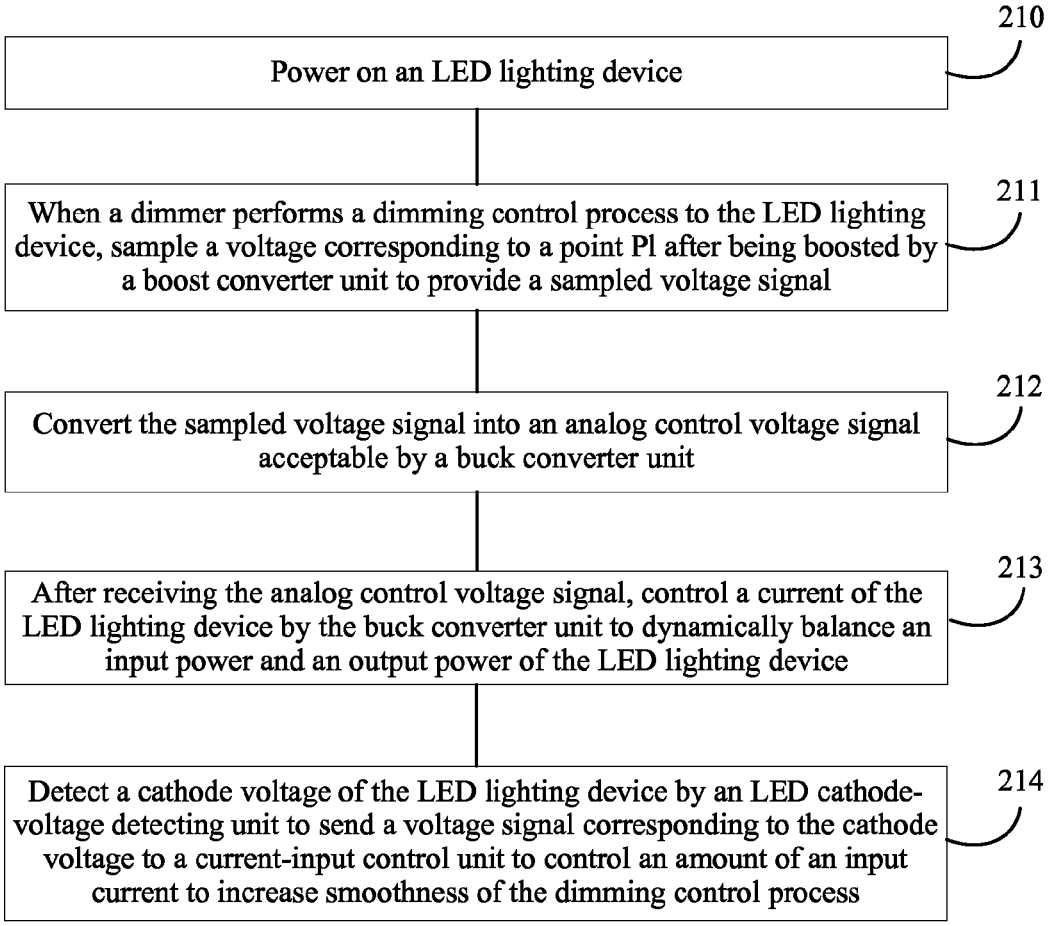
FIG. 2 is a schematic illustrating an exemplary driving method for an LED lighting device consistent with various disclosed embodiments.

FIG. 2 is a schematic illustrating an exemplary driving method for an LED lighting device consistent with various disclosed embodiments. Note that although the method depicted in FIG. 2 is described corresponding to the driver circuit in FIGS. 1A-1B, the driving method and the driver circuit are not limited in any manner.

For example, in Step 210, the LED lighting device can be powered on via the AC power supply 9.

In Step 211, when the dimmer 10 performs the dimming control process to the LED lighting device, a voltage corresponding to a point P1 in the driver circuit can be boosted by the boost converter unit 3. The boosted voltage can then be sampled to provide a sampled voltage signal.

In Step 212, the control-signal conversion unit 5 can convert the sampled voltage signal into an analog control voltage signal acceptable by the buck converter unit 6.

In Step 213, after the buck converter unit 6 receives the analog control voltage signal, the buck converter unit 6 can control an amount of a current of the LED lighting device. The current amount of the LED lighting device can be related to the dimming position at point P1 and related to the voltage at point P1.

According to the voltage corresponding to the point P1, the control-signal conversion unit 5 can automatically adjust a current amount required by the buck converter unit 6 to dynamically balance an input power (i.e., output power from the transformer) and an output power (i.e., power of the LED lighting device). In this manner, flashing or dimming failure phenomena of the LED lighting device do not occur.

In Step 214, the LED cathode-voltage detecting unit 7 can detect a cathode voltage of the LED lighting device and output a voltage signal corresponding to the cathode voltage to the current-input control unit 8. The current-input control unit 8 can be connected to the rectifying unit 2 to control a current from the rectifying unit 2. The current-input control unit 8 can then alter amount of the current from the rectifying unit 2 (which is used as an input current to the LED lighting device) to further increase smoothness of the dimming control process.

In this manner, by first boosting a voltage and then bucking the voltage at a point of dimming position, the LED lighting device can be controllably dimmed by a dimmer within a desired range. In one embodiment, the dimmer can define a point as the dimming position. The control-signal conversion unit can be used to automatically adjust a voltage signal at the point of the dimming position into an amount of a current required by the buck converter unit, to dynamically balance an input power (i.e., output power from the transformer) and an output power (i.e., power of the LED lighting device) of the LED lighting device. As such, flashing or dimming failure phenomena do not occur.

Therefore, the disclosed driver circuit and driving method for the LED lighting device do not require layout change of conventional lamps. The resultant LED lighting devices can be directly used to replace other lighting sources (e.g., incandescent lamps and/or halogen lamps). For example, the driver circuit can be installed within a lamp-head structure of the LED lighting device, which can be easily transported to replace other lighting sources. The disclosed LED lighting devices can be easy to install, and compatible with dimmers and transformers. Dimming performance and/or compatibility with electronic elements can be enhanced.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

Driver circuit and driving method for an LED lighting device are provided. The driver circuit includes an AC power supply, a dimmer, a transformer, and/or a dimming control circuit. The dimming control circuit includes a filtering unit, a rectifying unit, a control-signal conversion unit, a boost converter unit, a voltage feedback control circuit unit, and/or a buck converter unit.

A dimming position is defined at a point in a driver circuit by the dimmer to perform a dimming control process of the LED lighting device. A voltage corresponding to the point of the dimming position is boosted by the boost converter unit to provide a boosted voltage, which is then sampled and converted by the control-signal conversion unit into an analog control voltage signal acceptable by the buck converter unit. The buck converter unit alters an amount of a current of the LED lighting device, after receiving the analog control voltage signal.

As disclosed, by first boosting a voltage and then bucking the voltage at point of dimming position, the LED lighting device can be controllably dimmed within a desired range. The control-signal conversion unit can be used to automatically adjust a voltage signal at the point of the dimming position into an amount of a current required by the buck converter unit, to dynamically balance an input power (i.e., output power from the transformer) and an output power (i.e., power of the LED lighting device) of the LED lighting device. In this manner, flashing or dimming failure phenomena do not occur.

Therefore, the disclosed driver circuit and driving method of the LED lighting device do not require change of layout of conventional lighting systems. The resultant LED lighting devices can be used to replace other lighting sources (e.g., incandescent lamps and/or halogen lamps). For example, the driver circuit can be installed within a lamp-head structure of the LED lighting device, which can be easily transported to replace other lighting sources. The disclosed LED lighting devices can be easy to install, and be compatible with dimmers and transformers. Dimming performance and/or compatibility with electronic elements can be enhanced.

REFERENCE SIGN LIST

Filtering unit 1
Rectifying unit 2
Boost converter unit 3
Voltage feedback control circuit unit 4
Control-signal conversion unit 5
Buck converter unit 6
LED cathode-voltage detecting unit 7
Current-input control unit 8
AC power supply 9
Dimmer 10
Transformer 11
Dimming control circuit 12
Filter processing circuit 51
Analog-operation amplifier 52

What is claimed is:

1. A driver circuit of an LED lighting device, comprising:

an AC power supply, a dimmer, a transformer, and a dimming control circuit, the dimming control circuit comprises:

a filtering unit, configured to filter a voltage signal from the transformer and to output the voltage signal after filtering;

a rectifying unit, configured to receive the voltage signal from the filtering unit and to rectify the voltage signal into a DC signal to output;

a boost converter unit, configured to receive the DC signal from the rectifying unit to boost the DC signal to provide a boosted voltage according to a required DC voltage;

a voltage feedback control circuit unit, configured to control the boosted voltage from the boost converter unit;

a buck converter unit, configured to convert the boosted voltage into a voltage and a current required by the LED lighting device; and a control-signal conversion unit, connected to the boost converter unit, the voltage feedback control circuit unit, and the buck converter unit, respectively, wherein an amount of the current of the LED lighting device is related to a dimming position of the dimmer and related to a voltage corresponding to a point P1 of the dimming position, and wherein the control-signal conversion unit is configured to automatically adjust an amount of a current required by the buck converter unit, according to the voltage corresponding to the point P1 after being boosted by the boost converter unit.

2. The driver circuit of the LED lighting device according to claim 1, wherein the dimming control circuit further comprises:

an LED cathode-voltage detecting unit, configured to detect a cathode voltage of the LED lighting device and to output a voltage signal corresponding to the detected cathode voltage; and a current-input control unit, configured to receive the voltage signal from the LED cathode-voltage detecting unit and also to control an amount of a current from the rectifying unit to increase smoothness of the dimming control process.

3. A driving method for an LED lighting device, comprising:

powering on the LED lighting device;

when a dimmer performs a dimming control process to the LED lighting device, firstly sampling a voltage corresponding to a point P1 after being boosted by a boost converter unit to provide a sampled voltage signal by a control-signal conversion unit, wherein the boosted voltage from the boost converter unit is controlled by a voltage feedback control circuit unit;

converting the sampled voltage signal by the control-signal conversion unit into an analog control-voltage signal acceptable by a buck converter unit, wherein the control-signal conversion unit is connected to the boost converter unit, the voltage feedback control circuit unit, and the buck converter unit, respectively; and controlling an amount of a current of the LED lighting device by the buck converter unit after receiving the analog control-voltage signal, wherein the amount of the current of the LED lighting device is related to a dimming position of the dimmer and related to the voltage corresponding to the point P1 of the dimming position.

4. The driving method for the LED lighting device according to claim 3, further comprising:

detecting a cathode voltage of the LED lighting device by an LED cathode-voltage detecting unit;

sending a voltage signal corresponding to the cathode voltage from the LED cathode-voltage detecting unit to a current-input control unit; and controlling an amount of a current as an input current for the LED lighting device by the current-input control unit to increase smoothness of the dimming control process.

* * * * *